US005722485A

United States Patent [19]

Love et al.

[11] Patent Number: 5,722,485

[45] Date of Patent: Mar. 3, 1998

[54] LOUVERED FIN HEAT EXCHANGER

[75] Inventors: Daniel M. Love, Conrad, Iowa; John D. Lamkin, Grenada, Miss.

[73] Assignee: Lennox Industries Inc., Richardson, Tex.

[21] Appl. No.: 341,623

[22] Filed: Nov. 17, 1994

[51] Int. Cl.[6] ..... F28D 1/04

[52] U.S. Cl. ..... 165/151; 165/DIG. 503

[58] Field of Search ..... 165/151, 182

[56] References Cited

U.S. PATENT DOCUMENTS

| | | | |
|---|---|---|---|
| 4,434,844 | 3/1984 | Sakitani et al. | 165/151 |
| 4,469,167 | 9/1984 | Itoh et al. | 165/151 |
| 4,580,624 | 4/1986 | Ishida et al. | 165/151 X |
| 4,614,230 | 9/1986 | Sakuma et al. | 165/151 |
| 4,691,768 | 9/1987 | Obosu | 165/151 |
| 4,723,599 | 2/1988 | Hanson | 165/151 |
| 4,923,002 | 5/1990 | Haussmann | 165/151 |
| 5,042,576 | 8/1991 | Broadbent | 165/151 |
| 5,168,923 | 12/1992 | Sacks | 165/151 |
| 5,509,469 | 4/1996 | Obusu | 165/151 |

FOREIGN PATENT DOCUMENTS

| | | | |
|---|---|---|---|
| 493986 | 10/1938 | United Kingdom | 165/182 |

*Primary Examiner*—Leonard R. Leo

*Attorney, Agent, or Firm*—W. Kirk McCord

[57] ABSTRACT

An improved louvered fin heat exchanger having plural fins arranged in substantially parallel, closely spaced relation and a plurality of heat transfer tubes passing through aligned openings in the fins is disclosed. Each fin includes a plurality of first and second louvers which intersect a nominal plane of the fin at respective first and second angles such that the first louvers are in diverging relationship with the second louvers on one side of the fin and in converging relationship with the second louvers on an opposite side of the fin, thereby providing a bi-directional louver configuration. Each fin further includes a plurality of collars defining the respective fin openings. Each collar has a substantially cylindrical portion and two distinct base portions on one side of the fin which defines two distinct recesses on an opposite side of the fin. Each substantially cylindrical collar is adapted to engage the one of the recessed portions of an adjacent fin collar to facilitate alignment of the fins during assembly. The louvered fin of the present invention is particularly well-suited to accommodate smaller diameter (e.g., on the order of 5/16 inch) heat exchanger tubes.

19 Claims, 3 Drawing Sheets

LOUVERED FIN HEAT EXCHANGER

TECHNICAL FIELD

This invention relates generally to finned tube heat exchangers and in particular to an improved louvered fin heat exchangers.

BACKGROUND ART

So-called finned tube heat exchangers are widely used in a variety of applications in the fields of refrigeration, air-conditioning and the like. Such heat exchangers are comprised of a plurality of spaced parallel tubes in which a first heat transfer fluid such as water, oil, air or refrigerant flows while a second heat transfer fluid such as air is directed across the outside of the tubes. To improve heat transfer, a plurality of fins comprising thin sheets of metal are placed on the tubes. Each fin has a plurality of openings through which the tubes pass generally at right angles to the fins and a large number of the fins are arranged in parallel, closely spaced relationship along the tubes to form multiple paths for the second heat transfer fluid to flow across the fins and around the tubes.

The design of the fins is a critical factor in the heat transfer efficiency of the heat exchanger. Numerous fin designs have been proposed in the prior art to enhance heat transfer efficiency, compactness and manufacturability of finned tube heat exchangers. Many of these designs have involved enhancements to the fins such as interrupting the fins with a plurality of louvers, to cause numerous disruptions of the hydrodynamic boundary layers which form with increasing thickness along the fins and decrease heat transfer efficiency. Typically, such louvers are formed by first cutting the fin sheet at selected locations and then in a separate operation punching the fin material to form the louvers. Examples of prior art louvered fin heat exchangers are disclosed in U.S. Pat. Nos. 4,723,599 and 5,042,576.

Although louvered fins are advantageous from a heat transfer efficiency standpoint, the formation of the louvers adds complexity to the manufacturing process because two additional steps are typically involved, namely, cutting the fin material and then pushing the material up or down to form the louvers. Further, formation of the louvers increases the mechanical stresses on the fin sheets, which can cause deformation of the fins and other problems during the manufacturing process. This problem is of particular concern when the fins are formed to accommodate smaller diameter (e.g., on the order of 5/16 inch) tubes.

There is, therefore, a need for an improved louvered fin heat exchanger and in particular for a louvered fin heat exchanger designed to accommodate smaller diameter (e.g., 5/16 inch) heat exchanger tubes.

SUMMARY OF THE INVENTION

In accordance with the present invention, a heat exchanger is provided having plural fins arranged in substantially parallel, closely spaced relation and a plurality of heat transfer tubes passing through aligned openings in the fins and in intimate contact with the fins to allow the transfer medium flowing through the tubes to exchange heat with another heat transfer medium flowing across the surfaces of the fins. Each fin is comprised of a thin sheet of relatively lightweight (e.g., aluminum) metal with a center strip and opposed first and second edge strips defining a nominal plane of the fin, a plurality of louvers extending longitudinally along the fin and a plurality of openings spaced longitudinally along the fin. A plurality of first louvers are intermediate the first edge strip and the center strip and a plurality of second louvers are intermediate the center strip and the second edge strip. The first and second louvers intersect the nominal plane of the fin at respective first and second angles such that the first louvers are in diverging relationship with the second louvers on one side of the fin and are in converging relationship with the second louvers on an opposite side of the fin, thereby providing a bi-directional louvered configuration.

In accordance with another feature of the invention, the fin further includes a plurality of first connector strips extending transversely between the first edge strip and the first louvers, to interconnect the first edge strip and the first louvers and a plurality of second connector strips extending transversely between the second edge strip and the second louvers, to interconnect the second edge strip and the second louvers. By interconnecting all of the first louvers with the first edge strip and all of the second louvers with the second edge strip, the louvers are strengthened against breakage.

In accordance with yet another feature of the invention, the fin openings are defined by respective fin collars. Each collar has a substantially cylindrical portion and first and second base portions on one side of the fin, which define respective first and second recessed portions on an opposite side of the fin. The substantially cylindrical portion is adapted to engage the second recessed portion of an adjacent fin to facilitate fin nesting for assembly.

In accordance with still another feature of the invention, the substantially cylindrical portion extends beyond the first and second base portions. The first and second base portions are both annular and in concentric relationship about the substantially cylindrical portion, with the first base portion being radially enlarged with respect to the second base portion and being located between the nominal plane of the fin and the second base portion. The second base portion is located between the first base portion and the substantially cylindrical portion. Each first louver and each second louver extend from the first base portion of one collar to the first base portion of an adjacent collar, thereby strengthening the louvers against deformation and breakage, particularly during the manufacturing process. Deformation and breakage of the louvers are of particular concern when the fins are manufactured to accommodate smaller diameter (e.g., on the order of 5/16 inch) tubes. Therefore, the present invention is particularly well-suited for use in the design and manufacture of fins for such smaller diameter tubes. The invention is also useful in the design and manufacture of fins for larger diameter (e.g., 3/8 inch) tubes.

BEST MODE FOR CARRYING OUT THE INVENTION

The best mode for carrying out the invention will now be described with reference to the accompanying drawings. Like parts are marked throughout the drawings and specification with the same respective reference numbers. The drawings are not necessarily to scale and in some instances proportions may have been exaggerated in order to better illustrate certain features of the invention.

Figure 2:
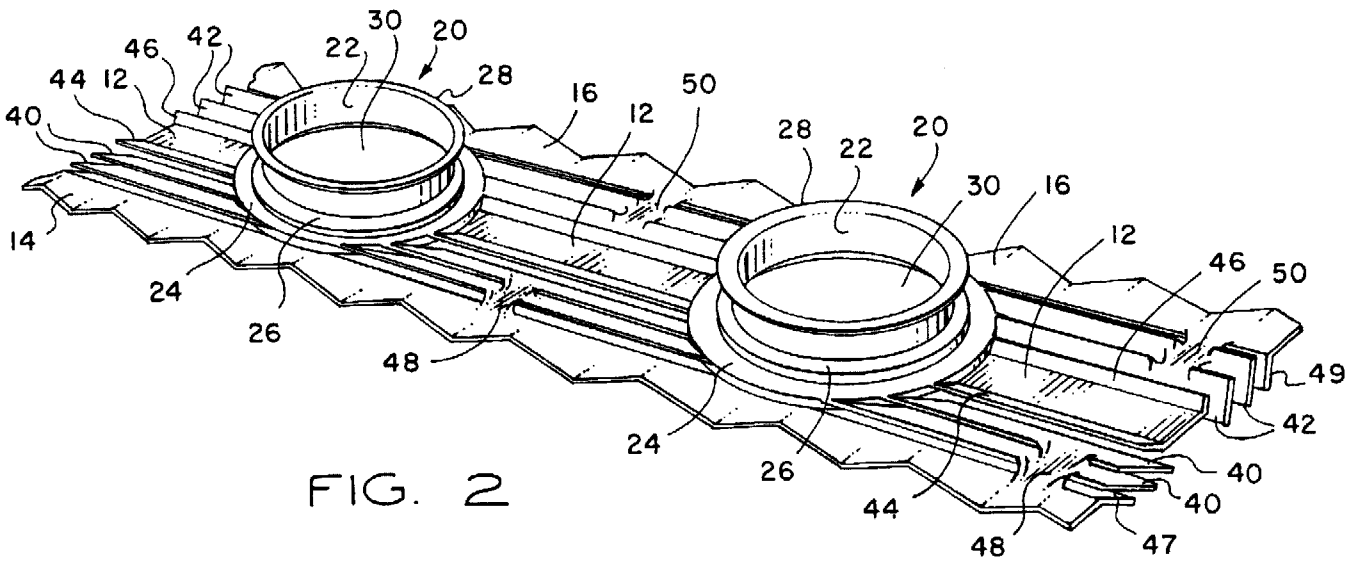
FIG. 2 is a partial perspective view of the fin of FIG. 1.
Figure 3:
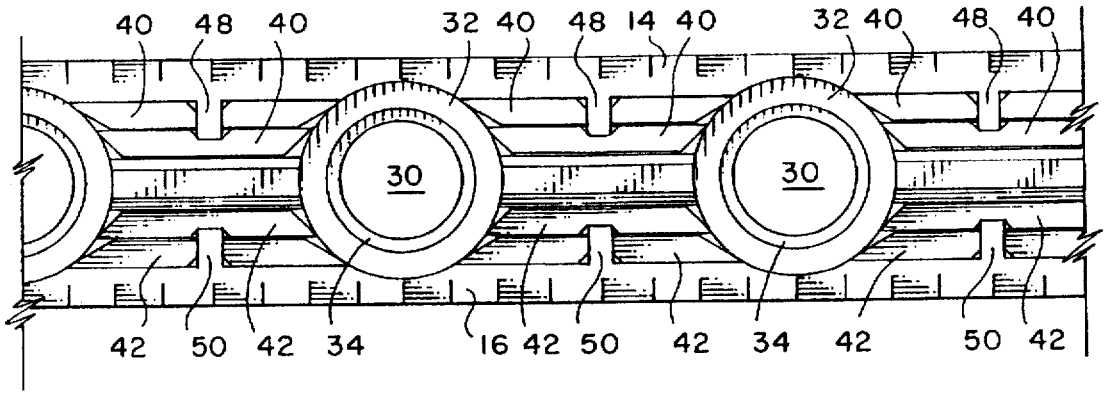
FIG. 3 is a plan view of the fin, having taken from the opposite side thereof from the plan view of FIG. 1.
Figure 4:
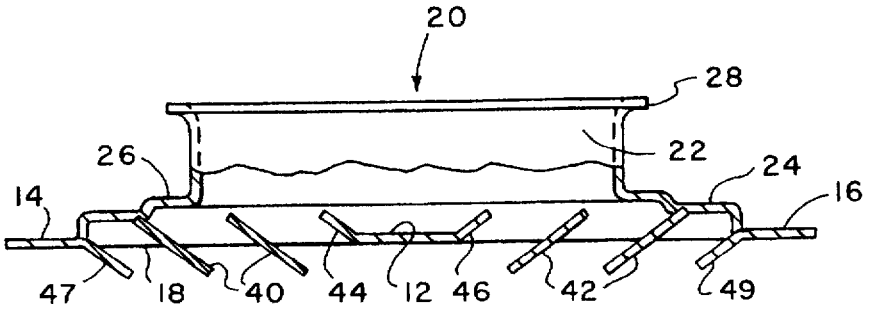
FIG. 4 is a sectional view taken along line 4—4 of FIG. 1.

Referring to FIGS. 1–6, a fin 10 for use in assembling a heat exchanger with a single row of tubes is depicted. Fin 10 is an elongated, relatively thin (e.g., 0.0045 inch) sheet of lightweight metal, such as aluminum. Fin 10 includes a center strip 12 and opposed first and second edge strips 14 and 16 extending longitudinally along fin 10. Strips 12, 14 and 16 define a nominal plane 18 (FIG. 4). Edge strips 14 and 16 extend substantially the entire length of fin 10, while center strip 12 is interrupted by a plurality of fin collars 20 spaced at predetermined intervals (e.g., 1 inch) longitudinally along fin 10. Each collar 20 includes a substantially cylindrical portion 22 elevated above nominal plane 18 and first and second annular base portions 24 and 26, respectively, in concentric relationship about cylindrical portion 22. The distal end of cylindrical portion 22 is defined by a radially outwardly extending flange 28. Cylindrical portion 22 defines a tube receiving opening 30, which is preferably sized to accommodate a 5/16-inch diameter tube. As such, the inside diameter of cylindrical portion 22 is on the order of 0.3225 inch plus or minus 0.001 inch.

Each collar 20 further includes respective first and second recessed portions 32 and 34, as shown in FIG. 3, which are complementary with respective first and second base portions 24 and 26. First base portion 24 is radially enlarged with respect to second base portion 26 and is intermediate nominal plane 18 and second base portion 26. Second base portion 26 is intermediate first base portion 24 and cylindrical portion 22. For example, as best seen in FIG. 4, first base portion 24 may extend approximately 0.015 to 0.020 inch above nominal plane 18; second base portion 26 may extend approximately 0.010 to 0.012 inch above first base portion 24; and cylindrical portion 22 may extend approximately 0.0385 to 0.125 inch (depending on the number of fins per inch in the assembled heat exchanger) above second base portion 26. Other dimension examples are as follows:

width of fin 10=0.625 inch;

inside diameter of first base portion 24=0.5 inch;

inside diameter of second base portion 26=0.385 inch;

width of center strip 12=0.075 inch;

width of each edge strip 14, 16=0.163 inch.

Figure 6:
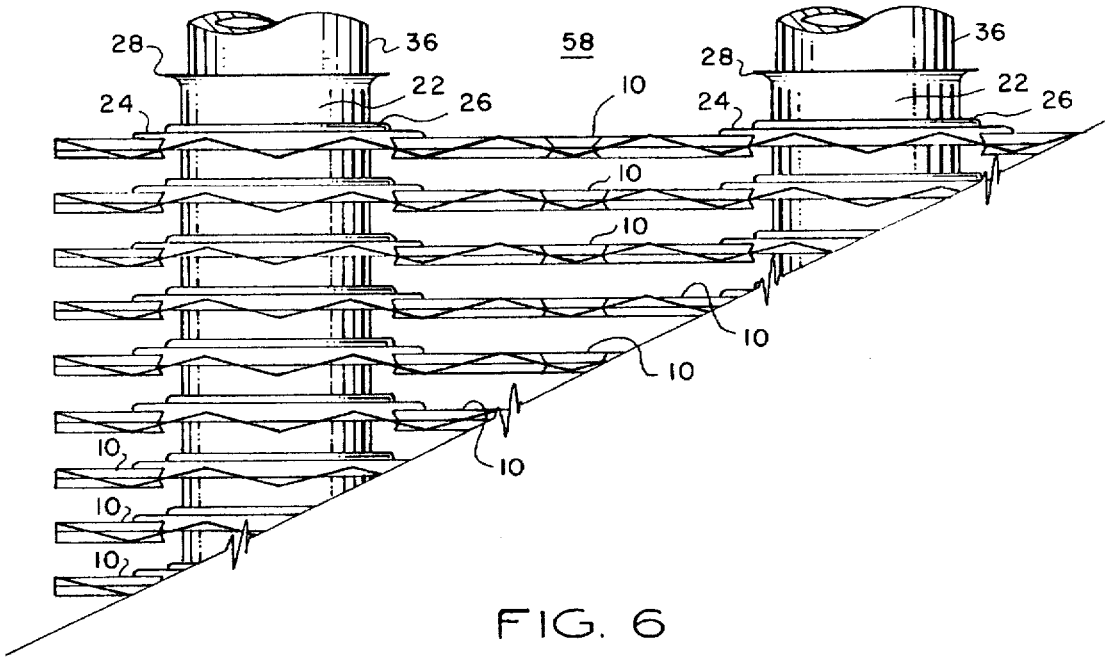
FIG. 6 is a detailed view of a portion of a heat exchanger with plural fins of the present invention.

The dual recessed portions 32 and 34 not only enhance the strength of fin 10, but also facilitate nesting of fins when plural fins are in closely spaced, parallel relationship with the corresponding fin openings in alignment for receiving a tube 36, as shown in FIG. 6. When two or more fins are nested, the flange 28 of each collar 20 engages a corresponding second recessed portion 34 of an adjacent fin, thereby defining a predetermined spacing between adjacent fins, which is approximately equal to the height of cylindrical portion 22 (e.g., 0.385 to 0.125 inch) less the combined depth of the corresponding first and second recessed portions 32 and 34 (0.025 to 0.032 inch).

Portions of fin 10 are cut and punched to form a plurality of first louvers 40 on one side of center strip 12 and a plurality of second louvers 42 on an opposite side of center strip 12. As can be best seen in FIG. 4, each louver 40, 42 is oriented at an angle of approximately 370 with respect to nominal plane 18. Louvers 40 are in parallel relationship with one another and louvers 42 are also in parallel relationship with one another. In accordance with a feature of the invention, louvers 40 are in diverging relationship with louvers 42 on the side of fin 10 on which first and second base portions 24 and 26 are formed and are in converging relationship with louvers 42 on the opposite side of fin 10 (i.e., the side on which recessed portions 32 and 34 are formed). This bi-directional louvered configuration equalizes the stresses on the fin 10 during the manufacturing process, thereby inhibiting fin deformation and breakage. Center strip 12 has flared walls 44 and 46. Wall 44 is in parallel relationship with louvers 40, while wall 46 is in parallel relationship with louvers 42. Edge strip 14 has a portion 47 depending therefrom which is parallel to louvers 40. Edge strip 16 has a portion 49 depending therefrom which is parallel to louvers 42. In operation, portions 47 and 49 and flared walls 44 and 46 cooperate with louvers 40 and 42 to direct air across fin 10.

Figure 1:
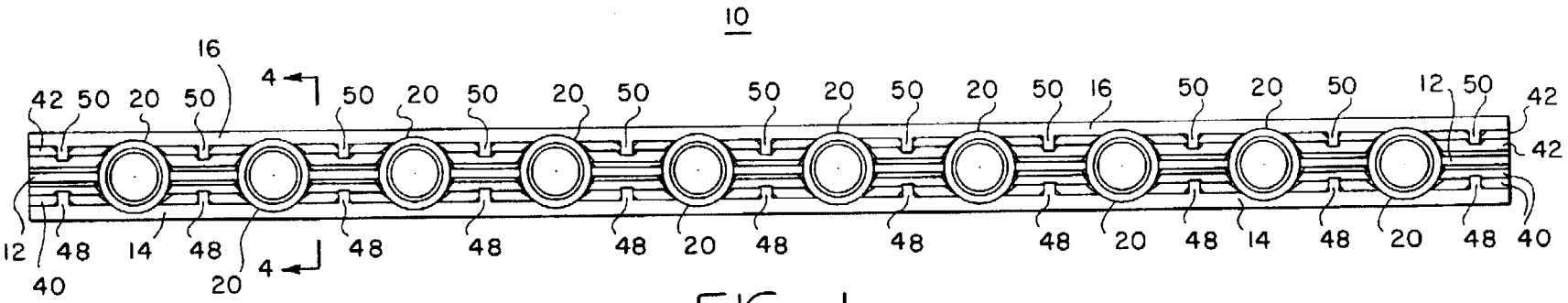
FIG. 1 is a plan view of a louvered heat exchanger fin, adapted to accommodate one row of heat exchanger tubes.

In accordance with another feature of the invention, each louver 40, 42 extends longitudinally the entire distance between adjacent collars 20, as can be best seen in FIG. 1. Specifically, each louver 40, 42 extends from the perimeter of the corresponding first base portion 24 of one collar 20 to the perimeter of the corresponding first base portion 24 of the next adjacent collar 20. By extending each louver 40, 42 all the way between adjacent collars 20, fin 10 is further strengthened against deformation and breakage. Center strip 12 is divided into sections by collars 20. Each section of center strip 12 extends from the corresponding first base portion 24 of one collar 20 to the corresponding first base portion 24 of the next adjacent collar 20. As can be best seen in FIG. 1, there are a first set of two louvers 40 and a second set of two louvers 42 between each adjacent pair of collars 20. Because each louver 40, 42 extends between corresponding first base portions 24 of adjacent collars 20, the outermost louvers 40, 42 (i.e., the particular louvers 40, 42 adjacent the corresponding edge strips 14, 16) are longer than the corresponding innermost louvers 40, 42 (i.e., the louvers 40, 42 adjacent to center strip 12).

In accordance with still another feature of the invention, fin 10 is further strengthened by bridging between edge strip 14 and each first set of two louvers 40 and between edge strip 16 and each second set of two louvers 42. A connector strip 48 extends transversely between first edge strip 14 and the two louvers 40 of each first set, thereby interconnecting strip 14, depending portion 47 and the two louvers 40 of the corresponding first set. A connector strip 50 extends transversely between second edge strip 16 and the two louvers 42 of each second set, thereby interconnecting strip 16, depending portion 49 and the two louvers 42 of the corresponding second set. There are one connector strip 48 and one connector strip 50 between each adjacent pair of collars 20. Each connector strip 48 is in transverse axial alignment with a corresponding connector strip 50. Each connector strip 48, 50 has a width of approximately 0.060 inch. This "double bridging" effect provided by connector strips 48 and 50 further strengthens the louvers 40, 42 against deformation and breakage.

Figure 5:
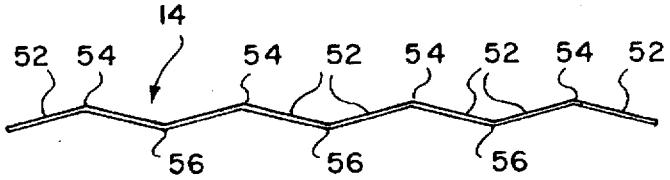
FIG. 5 is a side elevation view of the fin, illustrating the rippled edges thereof.

As can be best seen in FIGS. 2, 5 and 6, edge strips 14, 16 are ripple cut to define a plurality of corrugations 52 oscillating about nominal plane 18 of fin 10. Referring specifically to FIG. 5, the horizontal distance between the crest 54 of one corrugation 52 to the corresponding crest 54 of an adjacent corrugation 52 is approximately 0.25 inch. The vertical spacing between crest 54 and trough 56 of each corrugation is approximately 0.030 to 0.035 inch.

Referring to FIG. 6, a plurality of fins 10 are arranged in closely spaced parallel relationship with corresponding openings of adjacent fins in alignment for receiving tubes 36 to form a heat exchanger 58. The tubes 36 are expanded into heat transfer relationship with the various fin collars 20. In operation, air flowing through heat exchanger 58 is directed across fins 10 and around tubes 36 to transfer heat between the air and a heat transfer medium (e.g., refrigerant) flowing in tubes 36. The various fin enhancements (e.g., rippled edges 14 and 16, depending portions 47 and 49, louvers 40 and 42, and flared walls 44 and 46) cooperate to enhance the heat transfer efficiency of heat exchanger 58. Although fin 10 has been described above with reference to accommodating tubes with a diameter of 5/16 inch, fin 10 can also be configured for larger tube diameters, such as 3/8 inch. Further, although fin 10 has been described above with reference to a heat exchanger with a single row of tubes, the fin 10 according to the present invention may also be configured for use in a heat exchanger having multiple rows of tubes.

Figure 7:
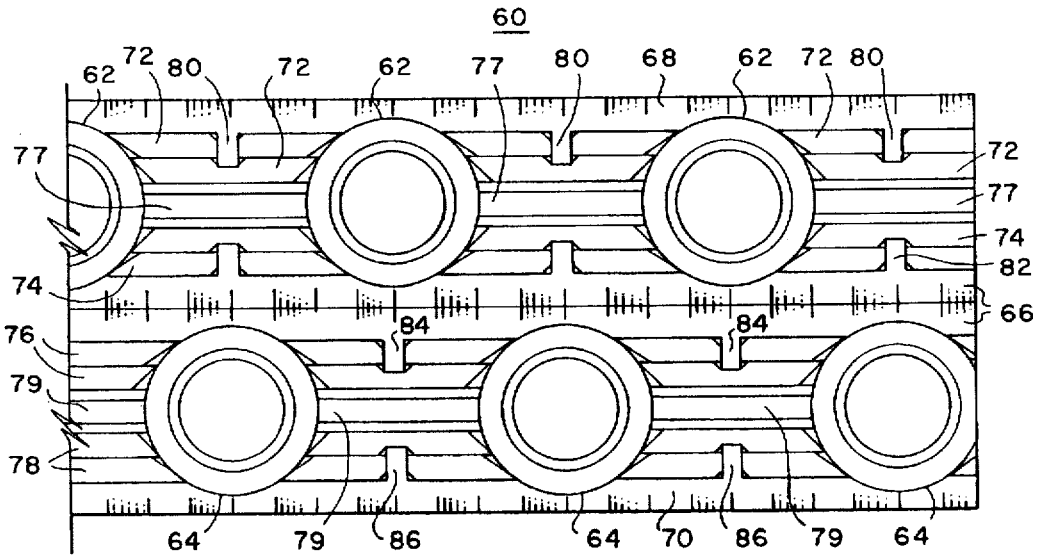
FIG. 7 is a plan view of an alternate embodiment of a louvered heat exchanger fin, adaped to accommodate two rows of heat exchanger tubes.

For example, FIG. 7 shows a fin 60 adapted to accommodate two rows of tubes. Fin 60 has a plurality of first and second fin collars 62 and 64, respectively, each of which is adapted to accommodate one row of tubes in the heat exchanger. Second collars 64 are offset in a transverse direction from the first fin collars 62. Further, fin 60 includes a center strip 66 intermediate the first and second collars 62 and 64 as well as opposed edge strips 68 and 70. Fin 60 includes a plurality of first, second, third and fourth louvers 72, 74, 76 and 78, respectively. There are a first set of two louvers 72 and a second set of two louvers 74 between each adjacent pair of collars 62. There are a third set of two louvers 76 and a fourth set of two louvers 78 between each adjacent pair of collars 64. The first and second louvers 72 and 74 define a first bi-directional louver configuration between the first collars 62 and the third and fourth louvers 76 and 78 define a second bi-directional louver configuration between the second collars 64. The first louvers 72 are substantially parallel to the third louvers 76 and the second louvers 74 are substantially parallel to the fourth louvers 78. Each louver 72, 74 extends from one first collar 62 to an adjacent first collar 62. Each louver 76, 78 extends from one second collar 64 to an adjacent second collar 64. A first strip 77 extends between the first collars 62 and a second strip 79 extends between the second collars 64. First louvers 72 are intermediate edge strip 68 and first strip 77. Second louvers 74 are intermediate first strip 77 and center strip 66. Third louvers 76 are intermediate center strip 66 and second strip 79. Fourth louvers 78 are intermediate second strip 79 and edge strip 70.

First connector strips 80 interconnect edge strip 68 with both of the louvers 72 of each first set; second connector strips 82 interconnect center strip 66 with both of the louvers 74 of each second set; third connector strips 84 interconnect center strip 66 with both of the louvers 76 of each third set; and fourth connector strips 86 interconnect both of the louvers 78 of each fourth set with edge strip 70. Each first connector strip 80 is in transverse axial alignment with a second corresponding connector strip 82 and each of the third connector strips 84 is in transverse axial alignment with a corresponding fourth connector strip 86.

The louvered fin heat exchanger assembled with a plurality of louvered fins described hereinabove provides significant advantages in terms of heat transfer efficiency and manufacturability, particularly with fins configured for smaller diameter tubes (e.g., 5/16 inch). The bi-directional louver pattern, together with the double recessed base portion of the fin collars and the double bridging provided by the transverse connector strips, not only enhances the strength of the fin, but also helps equalize the stresses to which the fin is subjected during the manufacturing process, thereby inhibiting deformation or other damage to the fin during manufacturing. Forming the louvers so that they extend completely between adjacent collars further enhances the strength of the fin. Further, the manufacturing process is facilitated and tooling cost reduced because the louvers are formed in a single step operation rather than in two distinct steps (cutting and then forming) associated with prior art fin forming processes.

Various embodiments of the invention have been described in detail. Since changes in or additions to the above-described embodiments may be made without departing from the nature, spirit or scope of the invention, the invention is not to be limited to said details, but only by the appended claims.

We claim:

1. A heat exchanger, comprising:

plural fins arranged in substantially parallel, closely spaced relation;

a plurality of heat transfer tubes passing through aligned openings in said fins and in intimate contact therewith to allow a heat transfer medium flowing through said heat transfer tubes to exchange heat with another heat transfer medium flowing across said fins, each of said openings having a diameter of about 5/16 inch;

each of said fins including:

a center strip and opposed first and second edge strips defining a nominal plane of said fin, said center strip and said first and second edge strips extending longitudinally along said fin;

a plurality of collars spaced longitudinally along said fin and defining said openings, each collar having a substantially cylindrical portion and first and second base portions on one side of said fin, said first and second base portions defining respective first and second recessed portions on an opposite side of said fin, each of said substantially cylindrical portions being engaged with one of said second recessed portions of an adjacent fin in said heat exchanger; and a plurality of first louvers extending longitudinally along said fin between said first edge strip and said center strip and a plurality of second louvers extending longitudinally along said fin between said center strip and said second edge strip, said first and second louvers intersecting said nominal plane at respective first and second angles such that said first louvers are in diverging relationship with respect to said second louvers on one side of said fin and in converging relationship with respect to said second louvers on an opposite side of said fin.

2. The heat exchanger of claim 1 wherein the substantially cylindrical portion of each collar extends beyond said first and second base portions on said one side of said fin, said first and second base portions being annular and in concentric relationship about said substantially cylindrical portion, said first base portion being radially enlarged with respect to said second base portion and being intermediate said nominal plane and said second base portion, said second base portion being intermediate said first base portion and said substantially cylindrical portion.

3. The heat exchanger of claim 2 wherein each of the first and second louvers extends from the first base portion of a collar to the first base portion of an adjacent collar.

4. The heat exchanger of claim 1 wherein each of said first and second edge strips is formed with corrugations to define respective first and second rippled edge strips.

5. The heat exchanger of claim 1 wherein each of said tubes has a diameter of about 5/16 inch, and each of said openings is generally circular.

6. The heat exchanger of claim 1 wherein each of said substantially cylindrical portions has a distal end which is engaged with a second recessed portion of an adjacent fin in said heat exchanger.

7. The heat exchanger of claim 1 further including a plurality of first connector strips extending transversely between said first edge strip and said first louvers for interconnecting said first louvers and said first edge strip, and a plurality of second connector strips extending transversely between said second edge strip and said second louvers for interconnecting said second louvers and said second edge strip.

8. A fin for use in assembling a heat exchanger having a plurality of said fins arranged in substantially parallel, closely spaced relation and a plurality of heat transfer tubes passing through aligned openings in said fins and in intimate contact therewith to allow a heat transfer medium flowing through the heat transfer tubes to exchange heat with another heat transfer medium flowing across said fins, said fin comprising:

a center strip and opposed first and second edge strips defining a nominal plane of said fin, said center strip and said first and second edge strips extending longitudinally along said fin;

a plurality of collars spaced longitudinally along said fin and defining said openings, each of said openings having a diameter of about 5/16 inch, each collar having a substantially cylindrical portion and first and second base portions on one side of said fin, said first and second base portions defining respective first and second recessed portions on an opposite side of said fin; and a plurality of first louvers extending longitudinally along said fin between said first edge strip and said center strip and a plurality of second louvers extending longitudinally along said fin between said center strip and said second edge strip, said first and second louvers intersecting said nominal plane at respective first and second angles such that said first louvers are in diverging relationship with respect to said second louvers on one side of said fin and in converging relationship with respect to said second louvers on an opposite side of said fin.

9. The fin of claim 8 wherein the substantially cylindrical portion of each collar extends beyond said first and second base portions on said one side of said fin, said first and second base portions being annular and in concentric relationship about said substantially cylindrical portion, said first base portion being radially enlarged with respect to said second base portion and being intermediate said nominal plane and said second base portion, said second base portion being intermediate said first base portion and said substantially cylindrical portion.

10. The fin claim 9 wherein each of said first and second louvers extends from the first base portion of one collar to the first base portion of an adjacent collar.

11. The fin of claim 8 wherein each of said first and second edge strips is formed with corrugations to define respective first and second rippled edge strips.

12. The fin of claim 8 wherein said substantially cylindrical portion is adapted to engage a second recessed portion of an adjacent fin in the assembled heat exchanger.

13. The fin of claim 8 further including a plurality of first connector strips extending transversely between said first edge strip and said first louvers for interconnecting said first louvers and said first edge strip, and a plurality of second connector strips extending transversely between said second edge strip and said second louvers for interconnecting said second louvers and said second edge strip.

14. A fin for use in assembling a heat exchanger having a plurality of said fins arranged in substantially parallel, closely spaced relation and a plurality of heat transfer tubes passing through aligned openings in said fins and in intimate contact therewith to allow a heat transfer medium flowing through the heat transfer tubes to exchange heat with another heat transfer medium flowing across said fins, said fin comprising:

a center strip and opposed first and second edge strips defining a nominal plane of said fin, said center strip and said first and second edge strips extending longitudinally along said fin;

a plurality of collars spaced longitudinally along said fin and defining said openings, each of said openings having a diameter of about 5/16 inch, each collar having a substantially cylindrical portion and first and second base portions on one side of said fin, said first and second base portions defining respective first and second recessed portions on an opposite side of said fin; and a plurality of first louvers extending longitudinally along said fin between said first edge strip and said center strip and a plurality of second louvers extending longitudinally along said fin between said center strip and said second edge strip, said first and second louvers intersecting said nominal plane at respective first and second angles such that said first louvers are in diverging relationship with respect to said second louvers on one side of said fin and in converging relationship with respect to said second louvers on an opposite side of said fin, each of said first and second louvers extending from the first base portion of one collar to the first base portion of an adjacent collar.

15. The fin of claim 14 wherein the substantially cylindrical portion of each collar extends beyond said first and second base portions on said one side of said fin, said first and second base portions being annular and in concentric relationship with said substantially cylindrical portion, said first base portion being radially enlarged relative to said second base portion and being intermediate said nominal plane and said second base portion, said second base portion being intermediate said first base portion and said substantially cylindrical portion.

16. The fin of claim 14 wherein each of said first and second louvers extends from the first base portion of one collar to the first base portion of an adjacent collar.

17. The fin of claim 14 further including a plurality of first connector strips extending transversely between said first edge strip and the first louvers to interconnect said first edge strip and the first louvers and a plurality of second connector strips extending transversely between said second edge strip and the second louvers to interconnect said second edge strip and the second louvers.

18. The fin of claim 14 wherein each of said first and second edge strips is formed with corrugations to define respective first and second rippled edge strips.

19. The fin of claim 14 wherein said substantially cylindrical portion is adapted to engage a second recessed portion of an adjacent fin in the assembled heat exchanger.

* * * * *